US010448492B1

(12) United States Patent
Wang et al.

(10) Patent No.: US 10,448,492 B1
(45) Date of Patent: Oct. 15, 2019

(54) PORTABLE GRADIENT CONTROL MAT

(71) Applicant: Manitoba Hydro, Winnipeg (CA)

(72) Inventors: Chenyang Wang, Winnipeg (CA); Emerson Adajar, Winnipeg (CA)

(73) Assignee: Manitoba Hydro, Winnipeg (CA)

( * ) Notice: Subject to any disclaimer, the term of this patent is extended or adjusted under 35 U.S.C. 154(b) by 0 days.

(21) Appl. No.: 15/952,968

(22) Filed: Apr. 13, 2018

(51) Int. Cl.
*H05F 3/02* (2006.01)

(52) U.S. Cl.
CPC ..... *H05F 3/02* (2013.01)

(58) Field of Classification Search
CPC ..... H05F 3/02
USPC ..... 174/559
See application file for complete search history.

(56) References Cited

U.S. PATENT DOCUMENTS 5,421,457 A * 6/1995 Listenberger ..... B65D 85/04 174/50
6,320,114 B1 * 11/2001 Kuechler ..... H01L 31/043 136/245
7,140,307 B1 * 11/2006 Wolbert ..... A47B 47/0075 108/153.1
7,669,718 B1 * 3/2010 Patty ..... A47F 5/108 206/600

* cited by examiner

*Primary Examiner* — Dhiru R Patel
(74) *Attorney, Agent, or Firm* — Ryan W. Dupuis; Adet Company Inc; Kyle R. Satterthwaite

(57) ABSTRACT

A portable gradient control plate providing protection against touch potentials for electrical workers that can be carried and set-up at workplace conveniently. The gradient control plate has a perforated top plate for stability and extra foot grip minimizing slip hazards. It is supported by aluminum members thus elevating the foot above grade. The gradient control plate can be folded through hinges and equipped with a handle introducing portability into the apparatus. Each aluminum plate is secured by a locking mechanism and bonded by a braided copper wire to ensure equipotential between plates. Aluminum rods for attaching hotline clamps will be placed on each side of the gradient control plate for electrical connection to the power source.

17 Claims, 13 Drawing Sheets

PORTABLE GRADIENT CONTROL MAT

FIELD OF THE INVENTION

This portable gradient control plate particularly relates to providing zone of protection to electrical workers and portability which can be conveniently carried and set-up in workplaces. In addition, it offers workers a sturdy and flat working surface making it easier to complete their tasks.

BACKGROUND

During the operation of various electrical equipment or installation/restoration procedure, such as transmission line switch operation, switchgear operation or string dropped conductor, a zone of protection against electrical shock is required to protect electrical workers and operators. In general, a permanent or portable gradient control protective device is needed to provide equal potential zone which mitigates touch potential hazard during the work.

Prior art protective devices cannot effectively protect an electrical worker or operator from transmission line level fault current while allowing the electrical worker or operator successfully completes his/her task. Some prior art protective devices have low limit of withstand fault current level which can only be used on the residential or industrial fault level. The actual fault current withstand level of some prior art protective devices is also questionable after the insulation layer becomes deteriorated or worn out. Also, some prior art protective devices are difficult to be inspected before use since the conductive component is hidden inside of the device.

Examples of prior art protective devices are disclosed in the following U.S. Pat. No. 4,637,575 to Yenzer; U.S. Pat. No. 4,885,659 to Nowell et al; U.S. Pat. No. 5,118,578 to Berger et al; U.S. Pat. No. 5,491,892 to Fritz et al; U.S. Pat. No. 5,646,370 to Perkins; U.S. Pat. No. 5,835,332 to White et al and U.S. Pat. No. 6,477,027 to McKelvy.

SUMMARY OF THE INVENTION

Accordingly, it is one object of the present invention to provide a temporary equipotential zone that provides electrical workers operating on energized equipment a higher level of protection against excessive touch potential.

Another object of the present invention is to provide bonding to touchable objects or energized equipment.

A further object of the present invention is to provide workers with flat, solid and robust working platform combined with perforations to minimize slip hazards.

Yet another object of the present invention is to provide workers with temporary gradient control plate that could be carried and set-up easily in various workplaces.

The abovementioned objects are achieved by providing a gradient control plate with connection to a touchable object or energized equipment. The plate is made of perforated aluminum to minimize risk of slipping and further reduce the total weight of the present invention. The total area of the plate is divided into sections and attached together by hinges to allow folding of the present invention. Each section is supported by an aluminum column attached to the perimeter and mid-portions of the plate providing elevation to workers from the ground, and each section is electrically bonded through braided wires attached at the back of the aluminum plate through aluminum column supports. Locking mechanisms are attached at the aluminum column supports to secure each section during "spread-out" form of the present invention. A further locking mechanism is installed to secure the present invention in the "folded" form and flexible covered cables functioning as handles to instigate portability of the present invention. Lastly, connecting rods attached at the side to allow connecting the present invention to energized equipment or touchable objects.

According to one aspect of the invention there is provided a portable gradient control mat defining an equipotential zone for workers thereon when connected to energized equipment; the mat comprising:

two panels formed of conductive material and defining respective upper supporting surfaces which are rigid and adapted to support the workers thereon;

a hinge mechanically coupling the two panels relative to one another such that the panels are pivotal between a working position in which the panels are substantially coplanar with one another and a stored position in which the panels are stacked adjacent one another;

a flexible conductor which is joined between the two panels to define a conductive pathway between the two panels independently of the hinge; and a locking assembly operatively connected to the panels so as to be movable between a locked condition in which the panels are retained in the working position and a released condition in which the panels are freely pivotal between the working position and the stored position.

When each panel includes side surfaces protruding downwardly from the upper supporting surfaces along opposing sides of the panel preferably the side surfaces of adjacent panels abut one another in the working position such that the panels can only be pivoted relative to one another in one direction from the working position.

Preferably the panels include two end panels and at least one intermediate panel connected in series with one another in a longitudinal row in the working position such that each adjacent pair of panels are joined by a hinge having a hinge axis in which the hinge axes are parallel to one another.

Preferably each intermediate panel receives adjacent panels against opposing surfaces of the panel such that the panels can be stacked in a zig-zag pattern within a single stack in the stored position.

Each panel may comprise a top plate defining the upper supporting surface of the panel and a plurality of plates spanning a height of the panel between a top and a bottom of the panel about a full perimeter of the top plate.

The flexible conductor is preferably fully supported below the upper surface of the panels. When each panel comprises a top plate defining the upper surface of the panel and supporting plates spanning a height of the panel between a top and a bottom of the panel to support the top plate spaced above the bottom of the panel, the flexible conductor is preferably received beneath the top plate, within a boundary between the top and the bottom of the panel.

When the panels include two end panels and at least one intermediate panel connected in series with one another in a longitudinal row in the working position such that each adjacent pair of the panels are joined by a hinge, preferably each adjacent pair of the panels are conductively connected by an independent pair of flexible conductors.

The flexible conductor may comprise a braided cable formed of conductive material.

The flexible conductor may be secured to each panel using threaded fasteners such that the flexible conductor is readily interchangeable with another flexible conductor which is identical in configuration.

The locking assembly may comprise a locking member which is pivotally mounted onto one of the panels so as to be engaged with the other panel in the locked condition and disengaged from the other panel in the released condition.

When each panel comprises a top plate defining the upper supporting surface of the panel and an end plate spanning a height of the panel between a top and a bottom of the panel to support the top plate spaced above the bottom of the panel, the locking assembly is preferably operatively connected between the end plates of the panels in the locked condition.

The locking assembly may include a locking member which is mounted between the panels in the locked condition and a biasing member which biased the locking member to remain in the locked condition.

When each panel comprises a top plate defining the upper supporting surface of the panel and supporting plates spanning a height of the panel between a top and a bottom of the panel to support the top plate spaced above the bottom of the panel, the mat may further comprise a strap member which is releasably connected between supporting plates in the stored position to selectively retain the panels in the stored position.

The mat may further comprise at least one conductor post mounted on one of the supporting plates to protrude outwardly from the mat for connection to the energized equipment.

The mat may further comprise a handle protruding from the supporting plates for carrying the mat in the stored position.

According to another aspect of the present invention there is provided a portable gradient control mat defining an equipotential zone for workers thereon when connected to energized equipment; the mat comprising:

two panels, each panel comprising (i) a top plate formed of conductive material and defining an upper supporting surface of the panel that is rigid and adapted to support the workers thereon and (ii) supporting plates spanning a height of the panel between a top and a bottom of the panel at sides of the panel to support the top plate spaced above the bottom of the panel;

a flexible conductor which is joined between the two panels to define a conductive pathway between the two panels such that the panels remain movable relative to one another between a working position in which the sides of the panels are abutted with one another such that the upper supporting surfaces of the panels are substantially coplanar with one another and a stored position in which the panels are stacked adjacent one another; and a locking assembly operatively connected to the panels so as to be operable between a locked condition in which the panels are retained in the working position and a released condition in which the panels are freely pivotal between the working position and the stored position.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
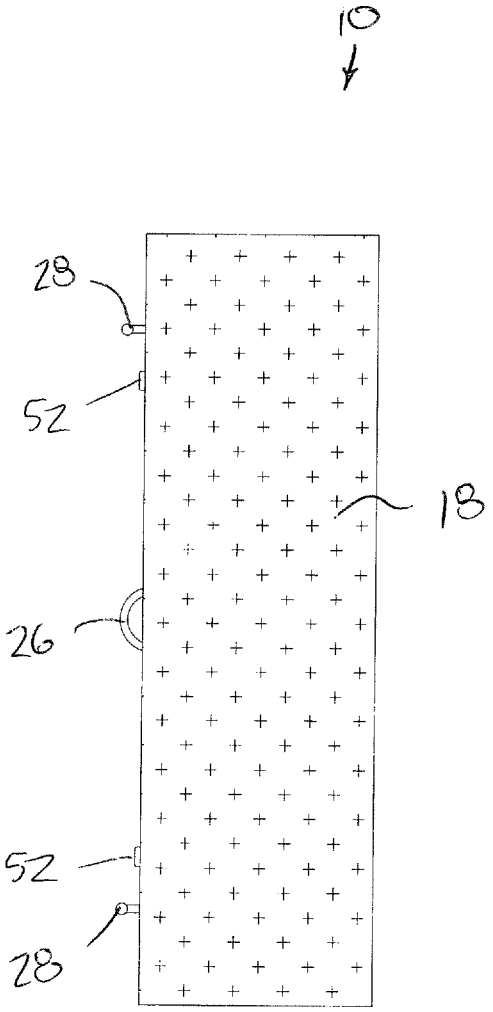
FIG. 1 is the top view of the portable gradient control mat in "folded" form.
Figure 2:
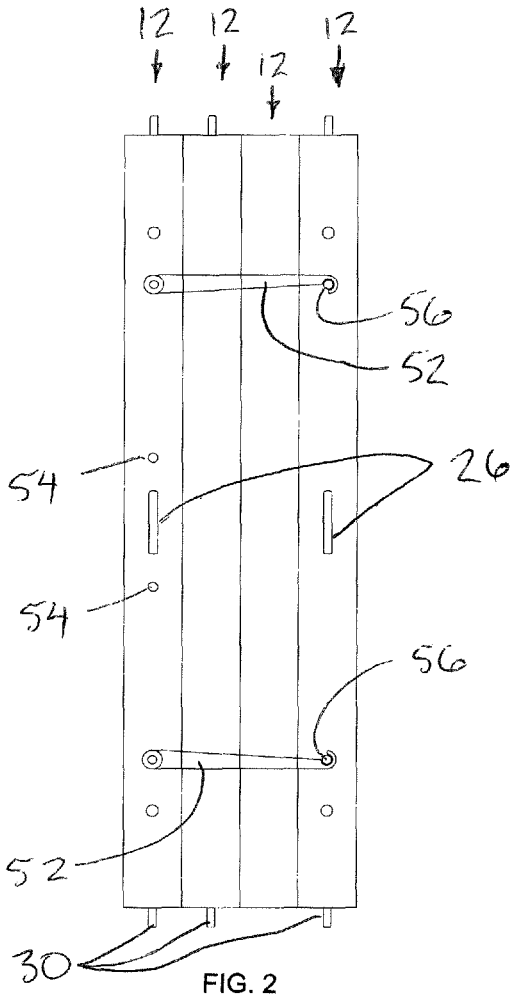
FIG. 2 is left side elevation view of the portable gradient control mat according to FIG. 1.
Figure 3:
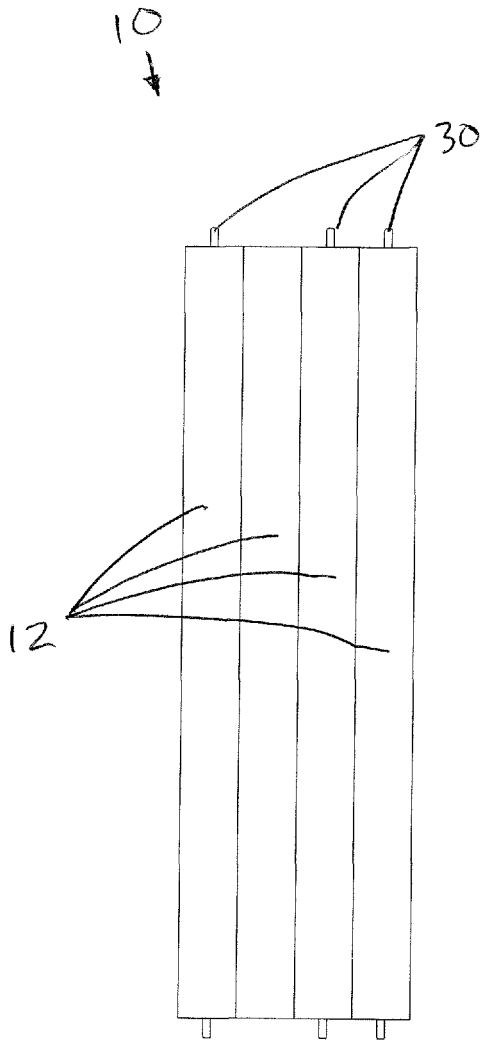
FIG. 3 is right side elevation view of the portable gradient control mat according to FIG. 1.
Figure 4:
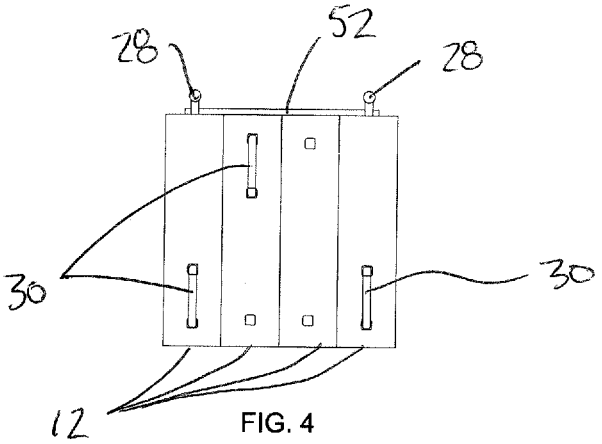
FIG. 4 is front elevation view of the portable gradient control mat according to FIG. 1.
Figure 5:
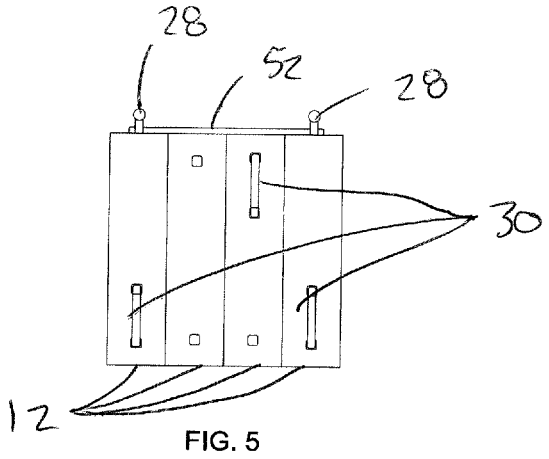
FIG. 5 is rear elevation view of the portable gradient control mat according to FIG. 1.
Figure 6:
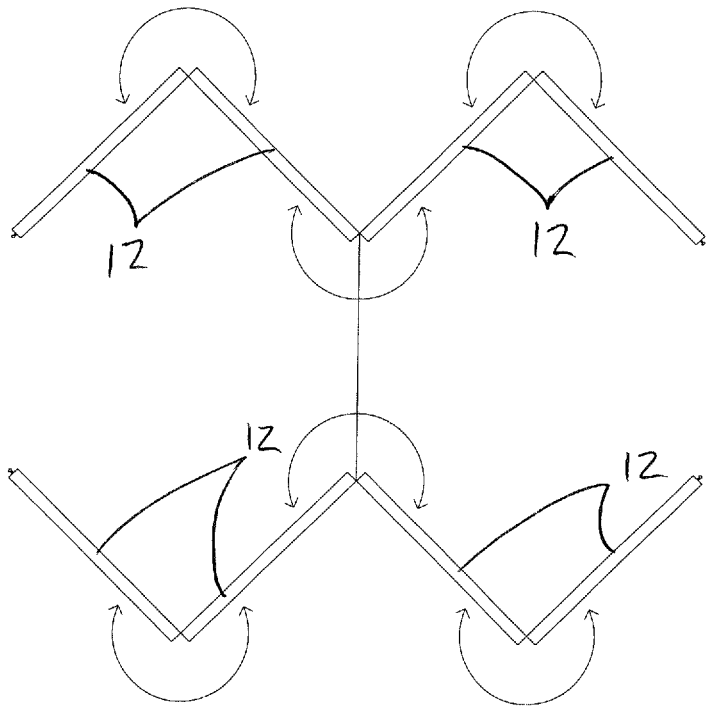
FIG. 6 shows transition from "folded" form the portable gradient control mat to "spread-out" form of the portable gradient control mat.
Figure 7:
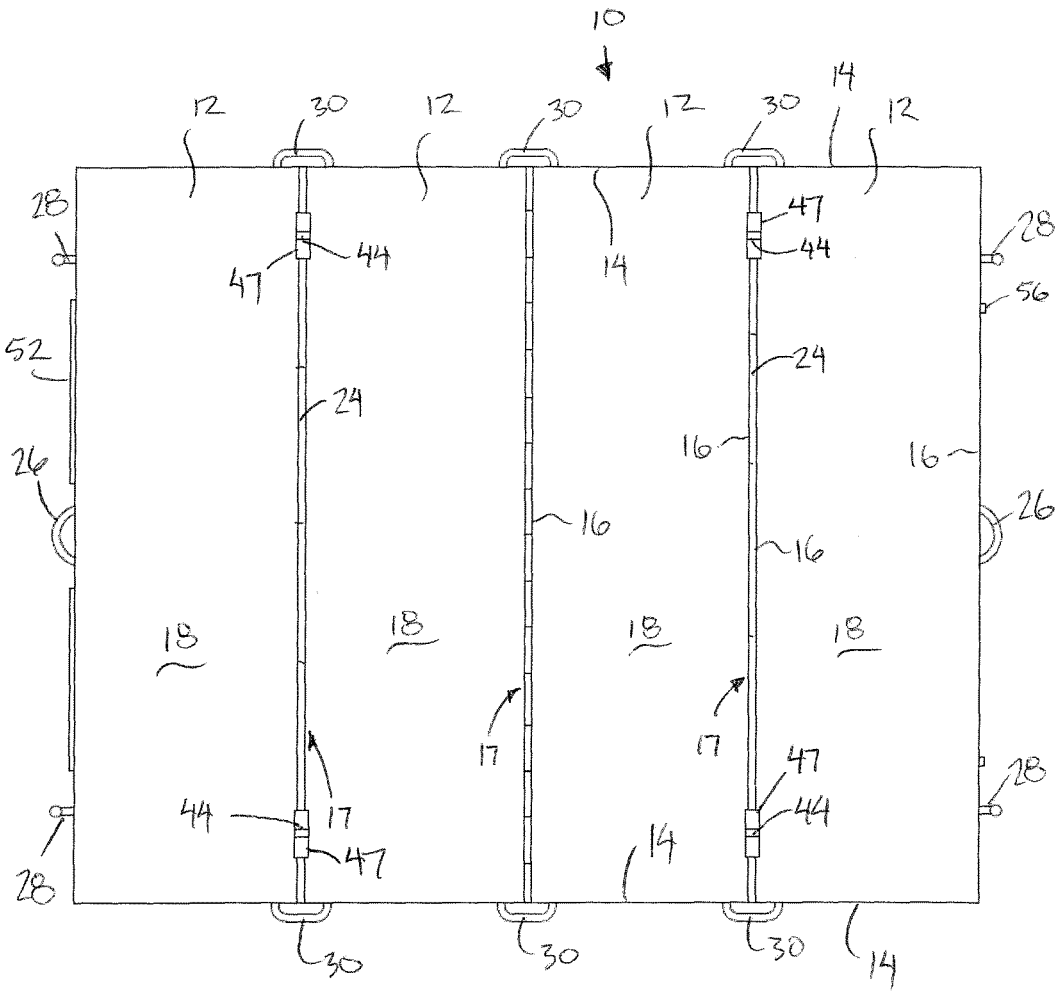
FIG. 7 is the top view of the portable gradient control mat in "spread-out" form.
Figure 8:
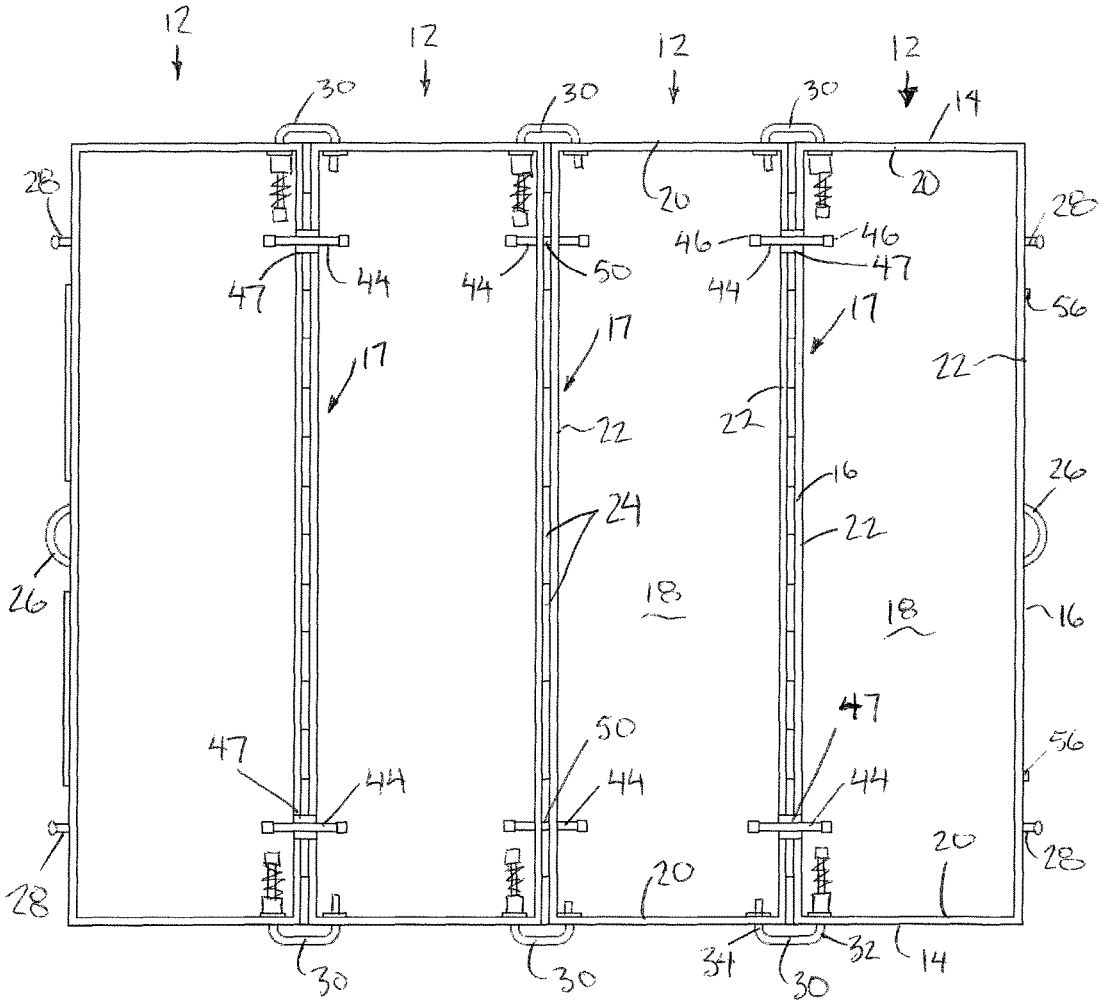
FIG. 8 is bottom view of the portable gradient control mat according to FIG. 7.
Figure 9:
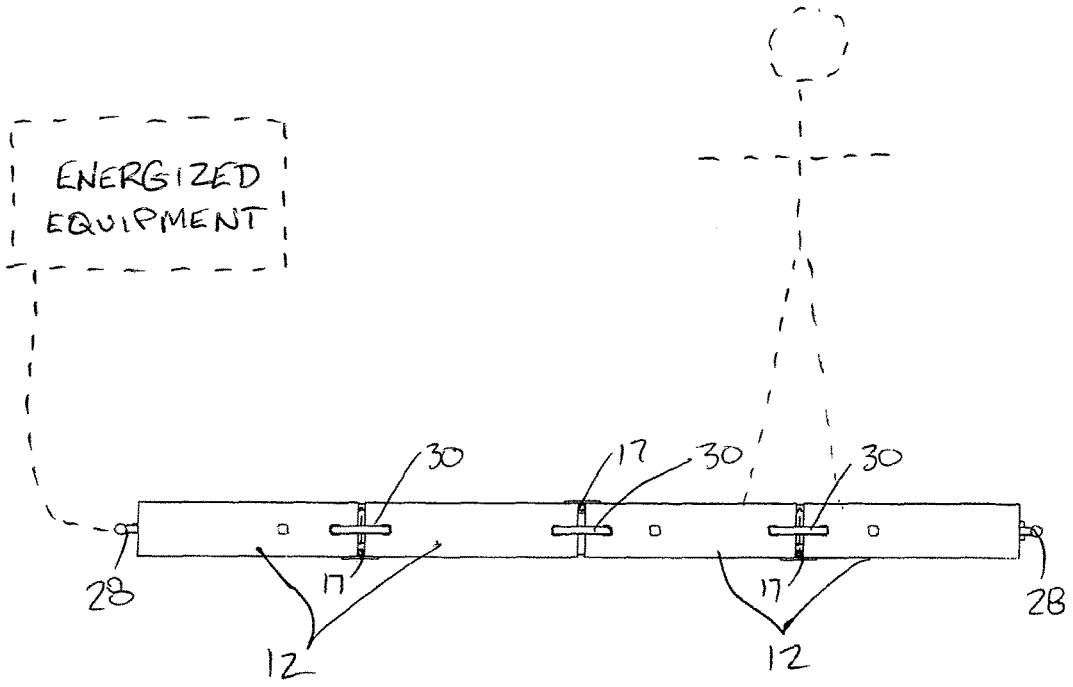
FIG. 9 is front elevation view of the portable gradient control mat according to FIG. 7.
Figure 10:
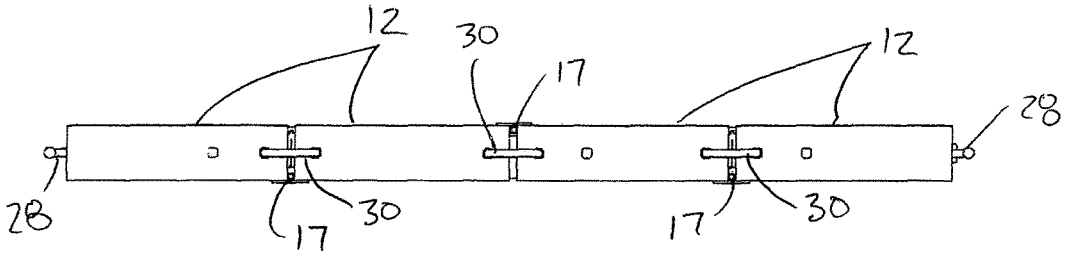
FIG. 10 is rear elevation view of the portable gradient control mat according to FIG. 7.
Figure 11:
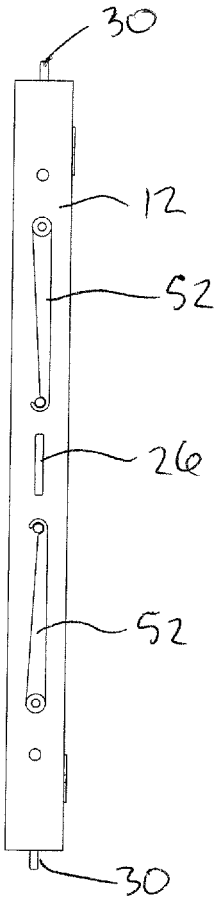
FIG. 11 is left side elevation view of the portable gradient control mat according to FIG. 7.
Figure 12:
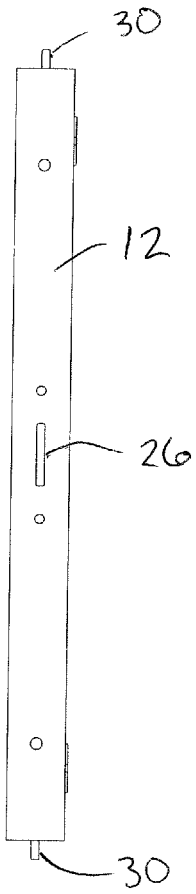
FIG. 12 is right side elevation view of the portable gradient control mat according to FIG. 7.
Figure 13:
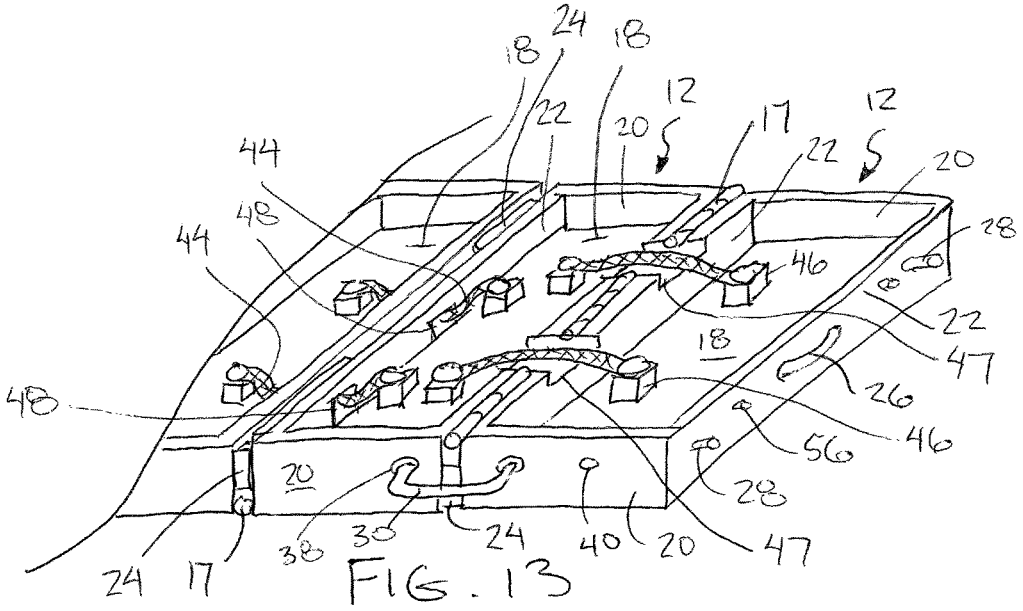
FIG. 13 is a perspective view of a portion of a bottom side of the portable gradient control mat.
Figure 14:
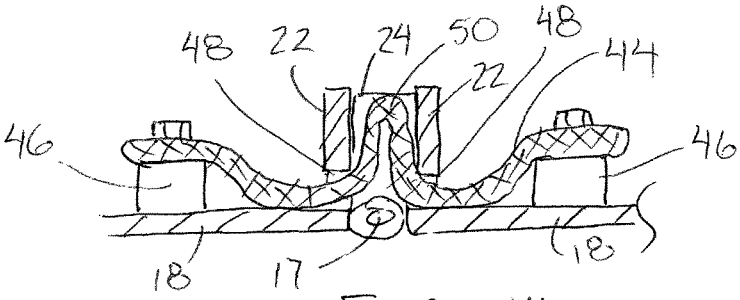
FIG. 14 is a sectional view of the hinge at a center of the mat between two intermediate panels of the mat.
Figure 15:
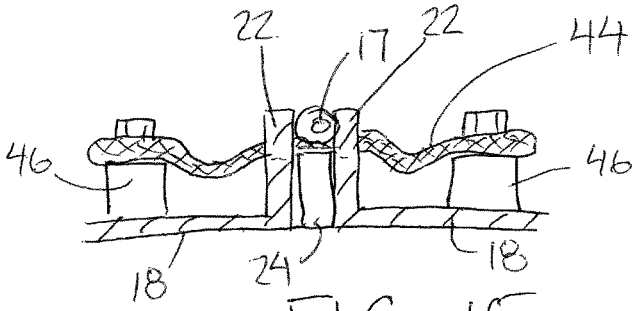
FIG. 15 is a sectional view of the hinge of one of the end panels of the mat.
Figure 16:
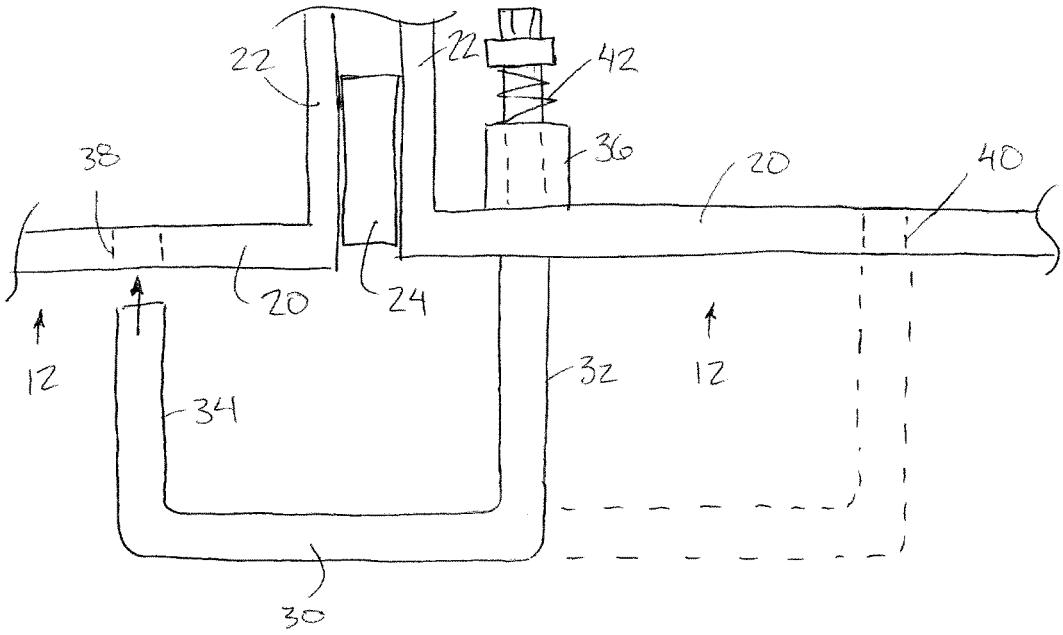
FIG. 16 is a bottom view of one of the locking members partway between the locked and released positions thereof.

Referring to the accompanying figures there is illustrated a portable gradient control mat generally indicated by reference numeral 10. The mat 10 is particularly suited for workers operating on energized equipment. In this instance the mat is laid on a suitable ground surface so as to be arranged for supporting a worker standing thereon while being conductively connected to the energized equipment to create an equipotential zone for the worker to perform work on the energized equipment and thereby minimize risk of electrical current passing through the worker.

The mat in the illustrated embodiment comprises four panels 12 which are connected in series to one another so as to be arranged to lie coplanar with one another in a working position abutted within a single row extending in a longitudinal direction of the deployed panels. Within the row of panels, there is accordingly defined two end panels at the opposing ends of the row, and two intermediate panels located at intermediate positions along the row between the end panels.

In the working position, each panel 12 spans the full width of the assembled the mat in a lateral direction, perpendicular to the longitudinal direction formed by the row of panels. Each panel is generally rectangular in shape so as to be elongate in the lateral direction between a pair of respective end plates 14 of the panel at laterally opposing sides of the mat. Each panel further includes two sides 16 which are laterally oriented to span the full length between the opposing ends 14 of the panel.

The panels are pivotally connected to one another so as to be movable into a stored position in which the panels are all stacked within a common stack. Each end panel is coupled to an adjacent intermediate panel by a suitable hinge structure 17 defining a common hinge axis of relative pivotal movement between the two panels. The two intermediate panels are pivotally coupled to one another by a respective hinge structure 17 also defining a common hinge axis of relative pivotal movement between the two panels in addition to each intermediate panel being pivotally coupled at the opposing side to the respective end panel.

Each panel 12 comprises a rigid top plate 18 defining an upper supporting surface suitable for supporting a worker standing thereon at the top side of the panel. The panel further includes two end plates at opposing ends 14 of the panel to extend downwardly in perpendicular relation to the top plate across the full height of the panel between the top and the bottom thereof.

Each panel also includes two side plates 22 at respective sides 16 which are perpendicular to the top plate to extend downwardly across the full height between the top and the bottom of the panel. In this manner the end plates 20 and the side plates 22 collectively extend about the full perimeter of the top plate 18 to function as a rigid column support for supporting the top plate 18 spaced above the ground when the bottom edges of the end plates 20 and side plates 22 are engaged upon the ground. Bottom edges of the plates 20 and 22 may include edge flanges lying in a common plane with one another which extend inwardly from the respective plate to define a broader surface at the bottom edge for engagement upon the ground.

The hinges 17 are coupled between adjacent ones of the panels 12 between the side plates 22 of the panels such that the side plates of the panels are spaced apart by a diameter of the barrel of the hinge in the working position. Along the row of panels in the longitudinal direction, the hinges 17 alternate between mounting locations at the bottom end of the top of the mat structure respectively. More particularly, the hinge connection of each end panel to the respective intermediate panel is located between the respective side plates 22 of the panels directly adjacent the bottom of the mat, whereas the hinge 17 between the intermediate panels is located between the side plates 22 of the panels directly adjacent the top of the mat.

By alternating the location of the hinges between the top and bottom of the panel in the longitudinal direction across the row of panels, the panels can be folded directly adjacent one another into a stacked configuration in which each intermediate panel is pivoted relative to the adjacent panels such that the adjacent panels lie flat against opposing sides of the intermediate panel. Furthermore, as the panels are pivoted from the working position towards the stored position, the panels collectively form a zigzag pattern or accordion-like pattern.

Spacer blocks 24 are provided having a thickness in the longitudinal direction of the mat corresponding approximately to the diameter of the barrel of the hinge structures. The spacer blocks 24 are mounted along one of the side panels of two adjacent panels at each hinge junction so as to be directly abutted between the side edges of adjacent panels in the working position. The spacer blocks thus act as a stop to prevent the panels from being pivoted relative to one another from the stored position to the working position beyond the working position. Accordingly, from the working position, the panels are pivotal relative to one another in only one direction through a range of approximately 180 degrees to the stored position.

The mat 10 further includes a pair of handles 26 mounted on the side plates 22 at longitudinally opposing ends of the row of panels so as to be situated at the outer side of the two end panels respectively. Each handle comprises a flexible cable anchored at opposing ends to the respective side plate 22 so as to lie within the boundary between the top and the bottom of the mat. When folded in the stored position, the handles protrude from a common side of the stack to be readily grasped by the user for portability.

In order to provide a conductive connection to the energized equipment being worked on, a set of four conductive posts 28 are also mounted within side plates 22 at the outermost ends of the end panels in the working position. More particularly, each side panel 22 supports two conductive posts 28 thereon such that the posts protrude longitudinally outward in parallel relation to the upper surface of the panels within the boundary between the top and bottom of the mat. The posts are formed of a highly conductive material and are rigidly connected in a conductive manner to the panels. A suitable conductive cable is attached between the energized equipment and a selected one of the conductive posts 28 for rigid connection thereto, for example using a threaded clamp and the like. By locating the pair of conductive posts 28 within each side panel 22 at opposing ends of the panel, the four posts 28 are situated in close proximity to the four corners of the assembled mat in the working position for convenience of the user.

Each hinge 17 that couples an adjacent pair of the panels 12 includes a pair of locking members 30 associated therewith. The locking members 30 are operatively connected between the end plates 22 of the adjacent panels at axially opposing ends of the hinge respectively. More particularly, each locking member comprises a generally U-shaped bar having a first leg 32 which is parallel to but longer in length than an opposing second leg 34 of the locking member. The legs are oriented parallel to the hinge axis with the first leg 32 being received within a corresponding sleeve structure 36 that is mounted within one of the end plates 22 such that the first leg is longitudinally slidable and pivotal about a long axis of the leg relative to the sleeve that is fixed on the end plate 22. By manipulating the locking member, the other leg can be displaced between a locked position and a released position relative to the end plate 22 of the adjacent panel. The connecting portion of the locking member 30 which connects between the first leg and the second leg is situated externally of the panels while the inner ends of the legs are received internally within the panels in either of the locked position or the released position.

In the locked position, the locking member bridges the seam between the adjacent panels so that the second leg is received within a corresponding lock aperture 38 in the end plate 22 of the adjacent panel such that the adjacent panels are held in fixed relation relative to one another in the coplanar working position.

In the released position, the second leg is received within a storage aperture 40 within the same end plate 22 that receives the first leg 32 therein. The first leg is sufficiently longer than the second leg to protrude inwardly beyond an inner end of the sleeve structure 36 within which it is received so as to receive a suitable spring 42 between the end of the sleeve and the inner end of the first leg to effectively bias the lock member inwardly into either one of the locked position or the released position thereof.

To displace the locking member between locked and released positions, the user grasps the external connecting portion of the locking member and pulls the locking member outwardly to slidably displace the first leg within the sleeve against the biasing of the spring until the second leg is fully withdrawn from the respective aperture within which it is received. Pivoting of the locking member about the first leg through 180° will displace the second leg from a position aligned with one of the lock aperture or the storage aperture to the other one of the lock aperture or the storage aperture. Releasing the locking member will result in the biasing of the spring drawing the second leg into the aperture within which it is received. When received in the storage position, the locking member does not interfere with pivoting movement of the adjacent panels so that the panels are freely pivotal from the working position towards a storage position, however when the second leg is received within the lock aperture 38, the adjacent panels are locked in the working position.

To conductively connect adjacent panels without relying on the mechanical connection of the hinge, independent conductive pathways are provided by a set of flexible conductors 44. More particularly each adjacent pair of panels is connected by two flexible conductors connected at opposing ends on respective lugs 46 which are fixed to the underside of the top plate of the adjacent panels. The lugs 46 are fully contained within a boundary of the panel between the top and the bottom thereof. Each end of each conductor 44 is clamped onto the lug using a suitable threaded bolt to tightly fix the conductor to the lug and provide a conductive connection of the conductor to the top plate of the respective panel. Each flexible conductor comprises a braided cable formed of flexible highly conductive material. The threaded connections which secure the conductor between the two lugs 46 of adjacent panels permits the flexible conductors to be readily removed and replaced as required if the conductors become worn or corroded and the like.

Each conductor extends across the seam between an adjacent pair of panels with a suitable passageway being provided across the hinge, however the configuration of the passageway differs depending upon whether the hinge is located at the top or the bottom of the mat.

When the hinge is located at the bottom, the hinges are simply provided with a gap in the axial direction at the location of the flexible conductor 44 with the bottom edge of the corresponding side plates 22 being cut away to form an upward recess 47 so that the flexible conductor can be received therethrough between adjacent panels while being fully contained within the boundary between the top and the bottom of the panel. This minimizes the conductor being crushed or otherwise worn by the weight of the panel edges engaged thereon when laid upon the ground.

When the hinge is located at the top side, both side plates 22 at the location of the flexible conductor includes a suitable aperture 48 formed therein directly adjacent the top plate through which the conductor is received. The gap between the side plates 22 of adjacent panels is suitably sized to receive a generally U-shaped portion 50 of the flexible conductor which receives some slack in the flexible conductor in the working position of the panels. The slack accommodates for the flexible conductor 44 having a pathway extending about the exterior of the hinge axis when folding into the storage position without placing unnecessary tension on the flexible conductor.

To secure the panels in the stacked configuration, the outer side plate 22 of one of the panels includes two strap members 52 supported thereon. Each strap member 52 is a rigid link pivotally coupled at one end onto the side plate so as to be pivotal between a stored position and a latching position. In the stored position the strap members lie generally parallel to the upper surface of the panel such that a hook at the end of each strap member opposite the pivot is retained on a suitable storage pin 54 protruding from the side plate. In the latching position, the strap members span perpendicularly to the upper surface of the panels so as to span across the full height of the stacked panels so that the hooks at the end of the strap members can be retained upon suitable latching pins 56 respectively. The latching pins 56 protrudes outwardly from the side plate 22 at the outer side of the other end panel of the mat. In this manner, the strap member has a suitable length between the pivot and the hook thereof to span the height of the stacked panels for retaining the panels in the stacked configuration in the latching position of the strap member.

The mat is typically stored in the stacked configuration with the strap members 52 in the latching position. In order to use the mat, the user releases the strap members 52 to permit the mat to be folded into the working position with the upper surfaces of the panels lying generally within a common plane at the top of the mat spaced above the bottom edges of the end plates 22 and side plates 24 which support the top plate spaced above the ground surface upon which the mat is engaged. The lock members are displaced from the released position to the locked position thereof to fix the mat in the working position. A suitable conductor cable is then connected between the energized equipment and one of the conductive posts 28 on the mat. The operator can then stand on the upper surface of the mat while performing work on the energized equipment within an equipotential zone defined by the mat. The reverse operation permits the mat to be stacked for ready transport to the next desired location for subsequent use. More particularly, the conductor cable is released from the associated conductive post 28 while the lock members 30 are pivoted into the released positions thereof so that the mat can be folded from the working position to the stored position in which the panels are stacked. The strap members 52 can then be returned to the latching position to retain the panels in the stacked configuration.

The portable gradient control plate for connecting to touchable objects and energized equipment providing equipotential zone to workers, as described herein generally includes (i) a number of solid metallic plates, (ii) supporting columns attached to the back of plates along the perimeter and mid-portions of the plates to provide reinforcement and elevation, (iii) braided wire permanently bonding adjacent plates, (iv) Hinges connecting adjacent plates and allow folding of the present invention, (v) Protruding rods for connecting touchable objects and energized equipment by the use of clamps and connectors, (vi) spring-loaded pivoting Locking mechanisms to firmly secure the present invention in "spread-out" form, (vii) Pivoting locking mechanism to secure present invention in "folded" form, and (viii) Flexible covered cables to allow ease of handling and transporting of present invention.

The control plate includes the following additional features: The plate is made of high conductive material. The plate is solid, sturdy and able to support load. The plates and supporting columns are mechanically connected. The supporting columns are made of high conductive material. The supporting columns are solid and sturdy and able to support load. The supporting columns are placed around the perimeter of the plate and in the mid-portion of the plate. The supporting columns are mechanically inter-connected. The plates are placed side-by-side. The adjacent plates are mechanically connected by hinges. The hinges are mechanically connected to the supporting column located on the perimeter of the plate. The hinges are mechanically connected such that hinges between a first plate and a second plate are connected at the bottom part of supporting column to allow top folding, while hinges between the second plate and a third plate are connected at the top portion of supporting column to allow back folding, and hinges between the third plate and a fourth plate are connected at the bottom part of supporting column to allow top folding. This alternating pattern will allow the plates to be folded in a "zig-zag" pattern. Preferably the means to electrically connect the present invention to energized equipment or touchable objects is through a protruding rod. The protruding rod is mechanically connected and electrically bonded to the supporting column located in the perimeter of the plate on first and fourth apparatus. Adjacent panels are electrically bonded through the use of braided wires made of high conductive material. The braided wires are mechanically connected permanently to the back of each plate. The braided wires electrically connect adjacent plates on two locations for redundancy. Spring-loaded pivoting locking mechanism supports the panels in "spread-out" form. The locking mechanisms are spring loaded to rotate to the lock state and rest state. The rotating locking mechanism is mechanically connected to the first apparatus on two locations. The rotating mechanism pivots onto the side supporting column and hooks to a rod mechanically connected to the fourth apparatus. The means to handle and transport the present invention is through flexible covered cables mechanically connected on two locations forming a loop on the first and fourth apparatus.

In further embodiments, the mat may comprise panels having a top plate and supporting plates spanning a height of the panels between top and bottom to support the top plate spaced above a bottom of the panels in which no hinges are provided. Instead, the sides of the adjacent panels, as defined by the supporting plates, are held in close abutment to restrict relatively pivotal movement therebetween in the working position. In this instance, only the flexible connectors serve to connect adjacent panels when the locking members are released so that the panels remain freely pivotal to be stacked in the stored position. In the working position, the panels remain abutted at the sides defined by the supporting plates together with a locking mechanism being used to ensure adjacent panels are locked together in the working position.

In yet further embodiments, the locking mechanism may include any suitable form of strap member which latches the top and/or bottom sides of the adjacent panels together. When using hinges at the top or bottom of an adjacent pair of panels, straps can be located within a plane of the opposing bottom or top of the panels. For example, straps retained by hook and loop fasteners and the like may connect two top plates of adjacent panels opposite from a hinge connecting the bottoms of the adjacent panels to lock the panels in the working position. Alternatively, when no hinge is provided, the sides of adjacent panels can be abutted such that the locking mechanism in this instance would comprise a first set of straps connected between the top plates of the adjacent panels and a second set of straps connected between the bottom sides of the adjacent panels to restrict relative pivotal movement upwardly or downwardly between adjacent panels and thus retain the panels in coplanar relationship within the working position. Locking members 30 as described above could also be used to lock adjacent panels in the working position even if no hinge is provided if the locking members are centrally located between the top and bottom of the panels or if the locking members are provided in pairs at the opposing top and bottom of the adjacent panels at each end of the hinge axis.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A portable gradient control mat in combination with energized equipment for supporting persons that are performing work on the energized equipment; the mat comprising:

two panels formed of conductive material and defining respective upper supporting surfaces which are rigid, the upper supporting surfaces being adapted to support said persons standing on the upper supporting surfaces of the panels;

a hinge mechanically coupling the two panels relative to one another such that the panels are pivotal between a working position in which the panels are substantially coplanar with one another and a stored position in which the panels are stacked adjacent one another;

a flexible conductor which is joined between the two panels to define a conductive pathway between the two panels such that the conductive material of the panels is in conductive communication with one another independently of the hinge;

a conductive cable operatively connected between the conductive material of the panels and the energized equipment such that the upper supporting surfaces of the panels define an equipotential zone in relation to the energized equipment; and a locking assembly operatively connected to the panels so as to be movable between a locked condition in which the panels are retained in the working position and in which the panels are substantially coplanar with one another and a released condition in which the panels are freely pivotal between the working position and the stored position.

2. The mat according to claim 1 wherein each panel includes side surfaces protruding downwardly from and perpendicularly to the upper supporting surfaces along opposing sides of the panel in which the side surfaces of adjacent panels abut one another in the working position such that the panels can only be pivoted relative to one another in one direction from the working position.

3. The mat according to claim 1 wherein the panels include two end panels and at least one intermediate panel connected in series with one another in a common longitudinal row in the working position such that each adjacent pair of panels are joined by a hinge having a hinge axis in which the hinge axes are parallel to one another.

4. The mat according to claim 3 wherein each intermediate panel receives adjacent panels against opposing surfaces of the panel such that the panels can be stacked in a zig-zag pattern within a single stack in the stored position.

5. The mat according to claim 1 wherein each panel comprises a top plate defining the upper supporting surface of the panel and a plurality of supporting plates perpendicular to the top plate and spanning a height of the panel between a top and a bottom of the panel about a full perimeter of the top plate.

6. The mat according to claim 1 wherein the flexible conductor is fully supported below the upper supporting surfaces of the panels.

7. The mat according to claim 6 wherein the panels each comprise a top plate defining the upper surface of the panel and supporting plates perpendicular to the top plate and spanning a height of the panel between a top and a bottom of the panel to support the top plate spaced above the bottom of the panel, the flexible conductor being received beneath the top plate, within a boundary between the top and the bottom of the panel.

8. The mat according to claim 1 wherein the panels include two end panels and at least one intermediate panel connected in series with one another in a common longitudinal row in the working position such that each adjacent pair of the panels are joined by a hinge and each adjacent pair of the panels are conductively connected by an independent pair of flexible conductors.

9. The mat according to claim 1 wherein the flexible conductor comprises a braided cable formed of conductive material.

10. The mat according to claim 1 wherein the flexible conductor is secured to each panel using threaded fasteners such that the flexible conductor is readily interchangeable with another flexible conductor which is identical in configuration.

11. The mat according to claim 1 wherein the locking assembly comprises a locking member which is pivotally mounted onto one of the panels so as to be engaged with the other panel in the locked condition and disengaged from the other panel in the released condition.

12. The mat according to claim 1 wherein each panel comprises a top plate defining the upper supporting surface of the panel and an end plate perpendicular to the top plate and spanning a height of the panel between a top and a bottom of the panel to support the top plate spaced above the bottom of the panel, the locking assembly being operatively connected between the end plates of the panels in the locked condition.

13. The mat according to claim 1 wherein the locking assembly includes a locking member which is mounted between the panels in the locked condition and a biasing member which biased the locking member to remain in the locked condition.

14. The mat according to claim 1 wherein each panel comprises a top plate defining the upper supporting surface of the panel and supporting plates perpendicular to the top plate and spanning a height of the panel between a top and a bottom of the panel to support the top plate spaced above the bottom of the panel, the mat further comprising a strap member which is releasably connected between supporting plates in the stored position to selectively retain the panels in the stored position.

15. The mat according to claim 1 wherein each panel comprises a top plate defining the upper supporting surface of the panel and supporting plates perpendicular to the top plate and spanning a height of the panel between a top and a bottom of the panel to support the top plate spaced above the bottom of the panel, the mat further comprising at least one conductor post mounted on one of the supporting plates to protrude outwardly from the mat in connection with the energized equipment.

16. The mat according to claim 1 wherein each panel comprises a top plate defining the upper supporting surface of the panel and supporting plates perpendicular to the top plate and spanning a height of the panel between a top and a bottom of the panel to support the top plate spaced above the bottom of the panel, the mat further comprising a handle protruding from the supporting plates for carrying the mat in the stored position.

17. A portable gradient control mat in combination with energized equipment for supporting persons that are performing work on the energized equipment above a ground surface; the mat comprising:

two panels, each panel comprising (i) a top plate formed of conductive material and defining an upper supporting surface of the panel that is rigid, the upper supporting surface being adapted to support said persons standing on the upper supporting surface of the panel, and (ii) supporting plates perpendicular to the top plate and spanning a height of the panel between a top and a bottom of the panel at sides of the panel to support the top plate spaced above the bottom of the panel when the bottom is supported on the ground surface;

a flexible conductor which is joined between the two panels to define a conductive pathway between the two panels such that (i) the conductive material of the top plates are in conductive communication with one another and (ii) the panels remain movable relative to one another between a working position in which the sides of the panels are abutted with one another such that the upper supporting surfaces of the panels are substantially coplanar with one another and a stored position in which the panels are stacked adjacent one another;

a conductive cable operatively connected between the conductive material of the panels and the energized equipment such that the upper supporting surfaces of the panels define an equipotential zone in relation to the energized equipment; and a locking assembly operatively connected to the panels so as to be operable between a locked condition in which the panels are retained in the working position in which the upper supporting surfaces of the panels are substantially coplanar with one another and a released condition in which the panels are freely pivotal between the working position and the stored position.

* * * * *